United States Patent [19]

Jensen et al.

[11] Patent Number: 4,773,822

[45] Date of Patent: Sep. 27, 1988

[54] PUMP COMPRISING A CANNED MOTOR

[75] Inventors: Niels D. Jensen, Bjerringbro; Bjarne Dissing, Hammel, both of Denmark

[73] Assignee: Grundfos International A/S, Denmark

[21] Appl. No.: 48,051

[22] Filed: May 11, 1987

[30] Foreign Application Priority Data

May 12, 1986 [DK] Denmark ..... 2192/86

[51] Int. Cl.[4] ..... F04D 29/16

[52] U.S. Cl. ..... 415/170 A; 415/26; 415/36; 415/146

[58] Field of Search ..... 415/170 A, 146, 26, 415/36, 42, 46, 48, 212 R, 213 R; 416/204 R, 204 A

[56] References Cited

U.S. PATENT DOCUMENTS

| | | | |
|---|---|---|---|
| 3,076,514 | 2/1963 | Garrison | 415/212 |
| 3,163,116 | 12/1964 | McCourty et al. | 415/146 |

FOREIGN PATENT DOCUMENTS

| | | | |
|---|---|---|---|
| 1061171 | 4/1954 | France | 415/213 |
| 1264210 | 5/1961 | France | 415/146 |
| 693836 | 6/1940 | Fed. Rep. of Germany | 415/146 |
| 1937120 | 4/1971 | Fed. Rep. of Germany . | |
| 68742 | 7/1926 | Sweden | 415/26 |

*Primary Examiner*—Robert E. Garrett
*Assistant Examiner*—John T. Kwon
*Attorney, Agent, or Firm*—Michael N. Meller

[57] ABSTRACT

A pump with a canned motor (1) comprises a hollow shaft (4) open at the ends (5, 6) and provided with shaft ends (7, 8) and made of a relatively thin-walled tube. The portions (7, 8) of the shaft (4) are of a reduced diameter ($d_1$, $d_2$). A reciprocating ball (12) is situated in the cavity between a first shaft portion (8) and a second shaft portion (7), said first shaft portion forming a shaft end and provided with a spline (17). This ball abuts seats (13, 14) resulting from the reduction of the diameter of the shaft portions (7, 8), whereby the ball (12) and the seats (13, 14) form a valve. In this manner the valve of the hollow shaft (4) is provided in a particularly simple manner as the seats (13, 14) can be provided simultaneously with the manufacture of the shaft portions (7, 8) of a reduced diameter. The shaft portion (8) carrying the impeller (10) is provided with a spline which provides the hollow shaft (4) with the necessary torsional strength.

9 Claims, 2 Drawing Sheets

PUMP COMPRISING A CANNED MOTOR

FIELD OF THE INVENTION

The invention relates to a pump comprising a canned motor and a hollow shaft open at the ends and provided with shaft ends and made of a relatively thin-walled tube, whereby portions of the shaft are of a reduced diameter.

BACKGROUND ART

Pumps of this type are known which are provided with a hollow shaft and used for instance as circulating pumps in central-heating plants. These pumps are, however, encumbered with the draw-back that the shaft is relatively expensive to manufacture because it is made of a solid material or a relatively thick-walled tube by cutting, which involves relatively high manufacturing costs for the shaft.

German Offenlegungsschrift No. 2447542 discloses furthermore the use of a hollow shaft in the form of a relatively thin-walled tube for relatively small, simple, and inexpensive pumps including a conventional electromotor. These pumps are, however, encumbered with the draw-back that they cannot transfer a high torque between the shaft and the impeller. Unlike the hollow shaft of a pump comprising a canned motor the hollow shaft of the above pump has no technical function beyond the transfer of the torque to the impeller.

A desire arises for providing a valve in the inner openings of the hollow shaft, said valve preventing the pump fluid from returning to the suction side through the hollow shaft, which causes a reduction of the efficiency of the pump. When the vent plug in the end wall of the motor housing is removed at inspection of the direction of rotation of the pump, the above valve prevents the pump fluid from flowing from the suction side upwards through the hollow shaft.

SUMMARY OF THE INVENTION

The object of the present invention is to provide a pump comprising a canned motor of the above type which comprises a hollow shaft including a valve therein in a particularly simple manner and possessing the strength necessary for transferring the torques in question to the impeller in spite of its small wall thickness.

The pump comprising a canned motor according to the invention is characterized in that a reciprocating ball is arranged in the cavity between a first shaft portion and a second shaft portion, said first shaft portion forming a shaft end and provided with a spline, on which an impeller is mounted, whereby the reciprocating ball abuts seats resulting from the reduction of the diameter at the shaft portions, the ball and the seats thereby forming a valve. In this manner the valve of the hollow shaft is provided in a particularly simple manner as the seats of the valve can be provided simultaneously with the manufacturing of the shaft portions of a reduced diameter. The shaft portion on which the impeller is mounted is provided with a spline which provides said shaft with the necessary torsional strength.

According to the invention the second shaft portion may be formed by the second shaft end of the hollow shaft, said second shaft end being shaped as a journal for the canned motor, which in practice turned out to be a particularly advantageous embodiment because in this manner the second shaft portion has two functions.

Furthermore according to the invention the spline on the first shaft portion may comprise a plurality of grooves extending parallel to the axis of the hollow shaft and being arranged in opposing pairs, said grooves preferably being shaped as cylindrical pressings. This embodiment turned out to be particularly easy to manufacture, and in addition it provides a large surface for the transfer of the torques in question.

Moreover according to the invention the ratio of the depth of the grooves to the outer diameter of the first shaft portion is in the range 0.02 and 0.15, preferably in the range 0.04 and 0.8. Such a ratio turned out to be particularly advantageous both as far as the necessary deformations and as far as the area for the transfer of the torques in question are concerned.

In addition according to the invention the thin-walled tube may be made of a corrosion-resistant material such as stainless steel and be of a thickness-diameter ratio of 0.04 to 0.2, preferably 0.06 to 0.14. In practice such a thickness-diameter ratio turned out to suffize for transferring the torques in question from the shaft to the impeller, and the use of a corrosion-resistant material such as stainless steel makes the pump suited for a wide range of purposes.

Furthermore according to the invention the radial clearance between the ball and the inner wall of the hollow shaft may be in the range 0.05 to 4 mm, especially between 1 and 2 mm, said radial clearances turning out to be particularly advantageous in practice.

Finally according to the invention the seats may form an angle of between 30° and 60°, preferably 40° and 50°, with the axis of the hollow shaft.

BRIEF DESCRIPTION OF THE DRAWING

The invention will be described more detailed below with reference to the accompanying drawing, in which.

DESCRIPTION OF PREFERRED EMBODIMENTS

Figure 1:
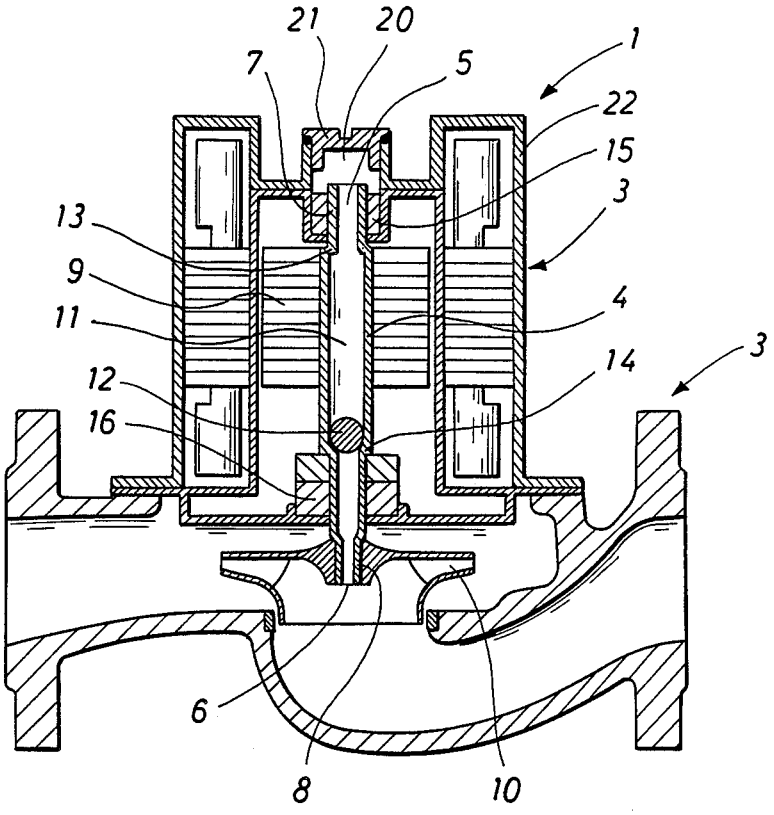
FIG. 1 is a diagrammatic, sectional view through an embodiment of a pump comprising a canned motor according to the invention.

FIG. 1 illustrates the pump 1 comprising a canned motor according to the invention. This pump comprises a pump housing 2 connected to a canned motor 3 with a motor housing 22. The motor housing comprises a vent plug 21 forming a seal for a leakage chamber 20 situated above the hollow shaft 4. The hollow shaft 4 is open at the ends 5, 6 and provided with shaft ends 7, 8 of a reduced diameter $d_1$, $d_2$ compared to the remaining diameter $d_3$ of the shaft 4. The rotor 9 of the pump comprising a canned motor 3 and the impeller 10 of the pump are mounted on the hollow shaft 4.

A reciprocating ball 12 is situated in the cavity 11 between the upper, cf. FIG. 1, shaft end 7 and the lower shaft end 8 provided with a spline and carrying the impeller 10. In response to the pressure in the cavity 11 the ball abuts either an upper seat 13 resulting from the reduction of the diameter at the upper shaft end 7 or a lower seat 14 resulting from the reduction of the diameter at the lower shaft end 8. During the usual working the ball 12 is pressed downwards towards the lower seat 14 by the pressure in the chamber 20 being higher at the upper shaft end 7 than on the suction side of the pump, i.e. at the lower shaft end 8. As a result a leakage reducing the efficiency is prevented from returning to the suction side of the pump. When the vent plug 21 in the motor housing 22 of the pump is removed for an inspection of the direction of rotation of the shaft 4, the ball is pressed upwards towards the upper seat 13 by the pressure being higher on the suction side than the pressure within the chamber 20. In this manner the pump fluid is prevented from leaving the pump through the hollow shaft 4.

The ball 12 is preferably made of rubber, plastics or a similar semi-resilient material so as to obtain a high sealing effect between the ball 23 and the seats 13 and 14.

In the embodiment of FIG. 1 the upper shaft end 7 of the hollow shaft 4 is a journal for a journal bearing 15 associated with the canned motor 3. Part of the lower shaft end 8 forms a journal for a combined radial/axial bearing 16 associated with the canned motor 3.

Figure 2:
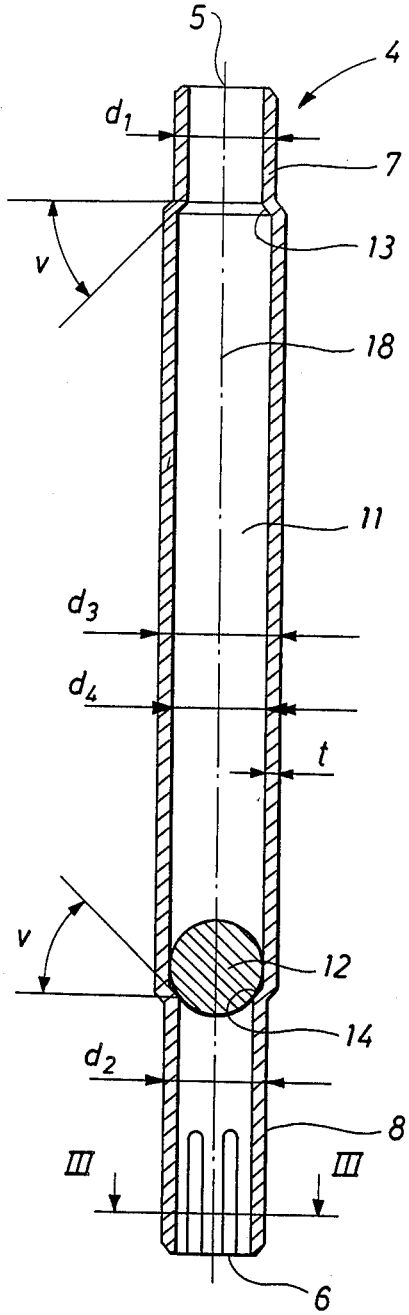
FIG. 2 is a longitudinal sectional view on a larger scale through a shaft of the pump comprising a canned motor.
Figure 3:
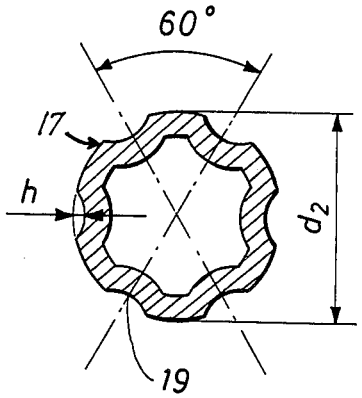
FIG. 3 is a sectional view taken along the line III-III of FIG. 2.

FIG. 2 is on a larger scale a vertical sectional view through the hollow shaft 4, and FIG. 3 is a sectional view taken along the line III—III of FIG. 2. As illustrated in these Figs. a spline 17 on the lower shaft end 8 comprises three pairs of opposing grooves 19 extending parallel to the axis 18 of the hollow shaft 4 and shaped as cylindrical pressings. These pressings 19 are uniformly distributed on the periphery of the hollow shaft 4 in such a manner that they are displaced 60° relative to one another. The ratio of the depth $\underline{h}$ of the pressings to the outer diameter $d_2$ of the shaft end 8 is in the range 0.02 to 0.15, preferably in the range 0.04 to 0.8.

The thickness-diameter ratio $\underline{t}d_3$ of the thin-walled tube—from which the hollow shaft is made—is in the range 0.04 to 0.2, preferably 0.06 to 0.14 because the tube is preferably made of a corrosion-resistant material such as stainless steel.

The radial clearance between the ball 12 and the inner wall at $\underline{d}_4$ of the hollow shaft 4 is preferably in the range 0.05 to 4 mm, especially 1 to 2 mm, and the inner diameter $\underline{d}_4$ of the hollow shaft 4 is preferably equal to the outer diameter $\underline{d}_3$ minus two times the wall thickness of the tube, a tube of a diameter not reduced between the shaft ends 7, 8 preferably being used.

The seats 13, 14 for the ball 12 form an angle $\underline{v}$ of between 30° and 60°, preferably between 40° and 50°, with the axis 18 of the hollow shaft, cf. FIG. 2.

The shaft portions 7, 8 of a reduced diameter $d_1$, $d_2$ are for instance produced by compressing the corresponding portions of a thin-walled tube of a starting diameter $d_3$. These portions are several pieces of tool of a geometry complementary to the shaft portions. A mandrel is optionally situated in the tube during the compressing procedure. The ball 23 is situated in the interior of the tube before the compressing procedure.

The invention may be varied in many ways without thereby deviating from the scope of the invention.

We claim:

1. A pump comprising a canned motor, a hollow shaft having a cavity with first and second seats mutually spaced therein, and a ball loosely arranged in a portion of said cavity between said first and second seats, said canned motor comprising a motor housing and first and second journal bearings fixedly arranged relative to said motor housing and respectively rotatably supporting said hollow shaft, said motor housing comprising a vent plug for sealing a leakage chamber located above said hollow shaft, said ball forming together with said first seat a first valve for preventing the flow of fluid from a suction side of the pump through said hollow shaft during removal of said vent plug and said ball forming together with said second seat a second valve for preventing the flow of fluid to said suction side of the pump through said hollow shaft during normal operation, wherein said shaft is made of relatively thin-walled tube, and said first and second seats are formed by compressing said tube material at both ends thereof, said first and second seats respectively forming transitions to first and second portions of said shaft, said first and second portions of said shaft having reduced diameters relative to the diameter of the shaft portion therebetween and defining first and second journals which are respectively supported by said first and second journal bearings.

2. The pump as defined in claim 1, wherein said thin-walled tube has a thickness-to-diameter ratio in the range of 0.04 to 0.2.

3. The pump as defined in claim 1, wherein a first end portion of said shaft is provided with a spline on which an impeller is mounted.

4. The pump as defined in claim 3, wherein said spline comprises a plurality of grooves extending parallel to the axis of said shaft and arranged in diametrically opposing pairs, said grooves being formed as cylindrical pressings.

5. The pump as defined in claim 4, wherein the ratio of the depth of the grooves to the outer diameter of the first end portion is in the range of 0.02 to 0.15.

6. The pump as defined in claim 1, wherein said thin-walled tube is made of corrosion-resistant material such as stainless steel.

7. The pump as defined in claim 1, wherein said ball is made of semi-resilient material such as rubber or plastic.

8. The pump as defined in claim 1, wherein the radial clearance between said ball and the inner wall of said hollow shaft is in the range of 0.05 to 4.0 mm.

9. The pump as defined in claim 1, wherein said seats form an angle of between 30 and 60 degrees with the axis of said hollow shaft.

* * * * *